US008689668B1

(12) United States Patent
Rider et al.

(10) Patent No.: US 8,689,668 B1
(45) Date of Patent: Apr. 8, 2014

(54) AUTOMATIC CRIMPING TOOL

(75) Inventors: Aaron Rider, Susquehanna, PA (US); Taylor Hale, Sparta, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/331,468

(22) Filed: Dec. 20, 2011

(51) Int. Cl.
*F42B 33/00* (2006.01)

(52) U.S. Cl.
USPC ..... 86/43; 83/39; 83/41

(58) Field of Classification Search
USPC ..... 86/39, 40, 41, 43
See application file for complete search history.

(56) References Cited

U.S. PATENT DOCUMENTS 4,862,567 A * 9/1989 Beebe ..... 86/43
6,244,154 B1 * 6/2001 Beebe et al. ..... 86/43
7,703,369 B1 * 4/2010 Lee ..... 86/43

* cited by examiner

*Primary Examiner* — James Bergin
(74) *Attorney, Agent, or Firm* — Michael C. Sachs

(57) ABSTRACT

An automatic crimping tool may be used to seat and crimp a projectile in a cartridge case. The tool may include a center sleeve having a blind bore at one end, an outer surface, a spring stop disposed on the outer surface, and at least one opening extending through a wall of the blind bore. The tool may include an outer sleeve having a through bore. The center sleeve may be reciprocably disposed in the through bore of the outer sleeve. The through bore may include a counter bore at one end and an enlarged portion located distal from the counter bore. A spring may be disposed between a flat portion of the counter bore and the spring stop. A retainer may bear against the spring stop to limit axial motion of the center sleeve. An inner sleeve may be disposed in the blind bore. The inner sleeve may be selectively translatable with the center sleeve. A second spring may be disposed between a closed end of the blind bore and the inner sleeve.

13 Claims, 9 Drawing Sheets

Fig. 7A
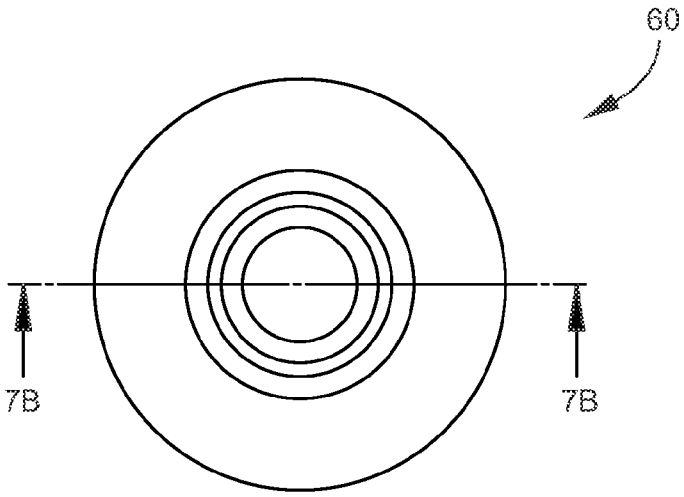
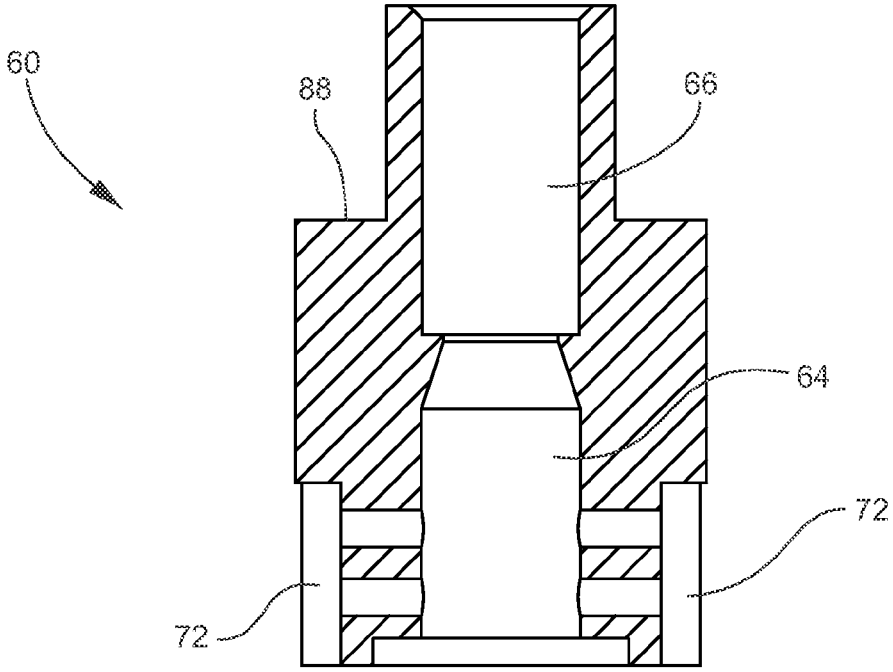
Fig. 7B

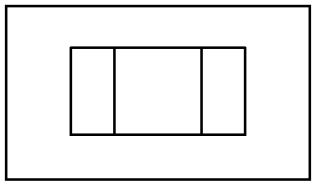
Fig. 9B
Fig. 9C
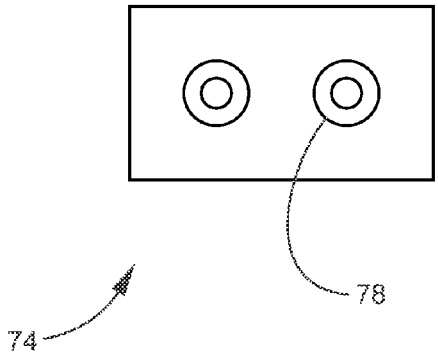
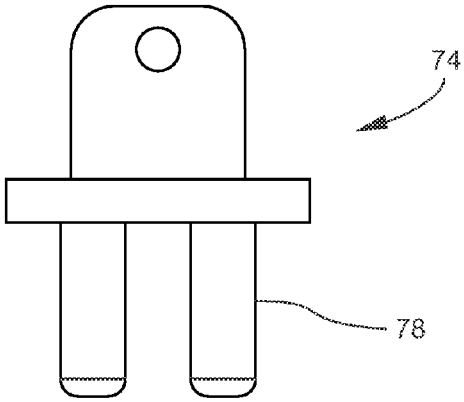
Fig. 9A
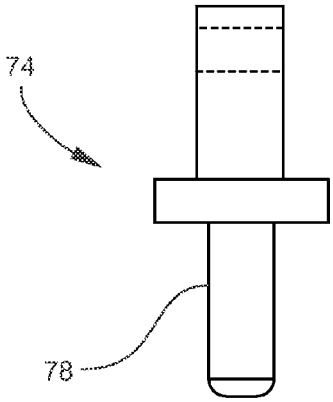
Fig. 9D

AUTOMATIC CRIMPING TOOL

STATEMENT OF GOVERNMENT INTEREST

The inventions described herein may be manufactured, used and licensed by or for the U.S. Government for U.S. Government purposes.

BACKGROUND OF THE INVENTION

The invention relates in general to ammunition and in particular to apparatus and methods for fixing projectiles in cartridge cases.

One type of ammunition is a round that may include a cartridge case and a projectile. The projectile may be seated in the cartridge case and then the cartridge case may be crimped around the projectile to hold the projectile in place. Known processes for seating a projectile and crimping a cartridge case may have required two separate fixtures and two separate sets of tools. Two separate fixtures and two separate sets of tools may be more expensive and logistically complex than a single fixture and a single set of tools. In addition, handling of the assembled cartridge may have been required prior to the crimping process. Handling an assembled cartridge prior to crimping may be hazardous.

A long-felt and unsolved need exists for an apparatus that can both seat a projectile in a cartridge case and crimp the cartridge case around the projectile, without the need for handling the cartridge between the seating and crimping steps.

SUMMARY OF THE INVENTION

It is an object of the invention to provide an apparatus that can both seat a projectile in a cartridge case and crimp the cartridge case around the projectile, without the need for handling the cartridge between the seating and crimping steps.

One aspect of the invention is an automatic crimping tool for seating and crimping a projectile in a cartridge case. The automatic crimping tool may include a center sleeve having a blind bore at one end, an outer surface, a spring stop disposed on the outer surface, and at least one opening extending through a wall of the blind bore. The at least one opening may be located axially between the spring stop and an open end of the blind bore.

The automatic crimping tool may include an outer sleeve having a through bore. The center sleeve may be reciprocably disposed in the through bore of the outer sleeve. The through bore may include a counter bore at one end and an enlarged portion located distal from the counter bore. A spring may be disposed between a flat portion of the counter bore and the spring stop. A retainer may bear against the spring stop to limit axial motion of the center sleeve. An inner sleeve may be disposed in the blind bore. The inner sleeve may be selectively translatable with the center sleeve. A second spring may be disposed between a closed end of the blind bore and the inner sleeve.

The center sleeve may include a ram mating portion at another end. The ram mating portion may include an internally threaded bore. The retainer may include a retaining ring disposed in a wall of the counter bore. The inner sleeve may include an opening therein for receiving a projectile. An outer surface of the inner sleeve may include a decreased diameter portion. At least one bearing may be disposed in the at least one opening extending through the wall of the blind bore.

When the at least one bearing is partially disposed in the decreased diameter portion of the outer surface of the inner sleeve, the inner sleeve may translate with the outer sleeve. When the at least one bearing is partially disposed in the enlarged portion of the through bore of the outer sleeve, the inner sleeve may not translate with the outer sleeve. Transition areas from the enlarged portion of the through bore to the through bore may be smooth transitions and not step transitions.

The automatic crimping tool may include a crimper base assembly. The crimper base assembly may include a crimper base and a crimper top disposed on the crimper base. The crimper base and crimper top may include bores for containing the cartridge case. The crimper top may include a center sleeve bore for receiving the center sleeve. The crimper base assembly may include at least one locking block extending from the crimper base to the crimper top. The locking block may be fixed to the crimper base. The crimper base and the crimper top may include slots formed therein for receiving the at least one locking block.

The crimper base assembly may include at least one locking pin for securing the locking block to the crimper top. The locking block may be fixed to the crimper base with fasteners inserted through the locking block and into the crimper base. The locking pin may include projections that extend through the locking block and into the crimper top.

Another aspect of the invention is a method. The method may include providing an automatic crimping tool, seating a projectile in a cartridge case, and crimping the cartridge case to the projectile using the automatic crimping tool. Seating the projectile in the cartridge case and crimping the cartridge case to the projectile may not include removing the cartridge case from the crimper base assembly between the seating and the crimping.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 7A is a top view of the crimper top shown in FIGS. 5A-B.

FIG. 7B is a sectional view along the line 7B-7B of FIG. 7A.

FIGS. 9A-D are front, top, bottom, and side views, respectively, of the locking pin shown in FIGS. 5A-B.

DETAILED DESCRIPTION OF THE PREFERRED EMBODIMENTS

An automatic crimping tool may be used in conjunction with a press having a ram, such as a hydraulic press. The automatic crimping tool may seat a projectile at an appropriate depth in a cartridge case, and then crimp the cartridge case around the projectile. The crimping tool may be attached to the ram of the hydraulic press. The hydraulic press may be configured to operate in a location that is remote from personnel. In this way, the possibility of injury to personnel that may occur during the seating and/or crimping process may be eliminated.

Figure 1A:
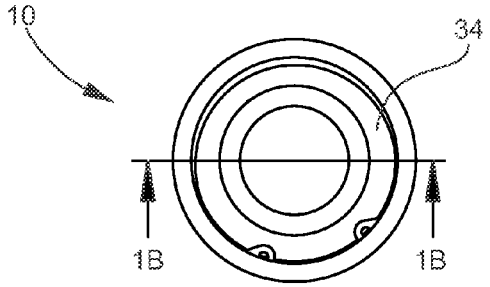
FIG. 1A is a top view of one embodiment of an automatic crimping tool.
Figure 1C:
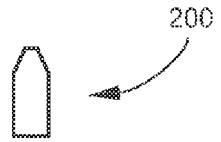
PRIOR ART Fig. 1C
FIG. 1C is a side view of a known projectile.
Figure 1B:
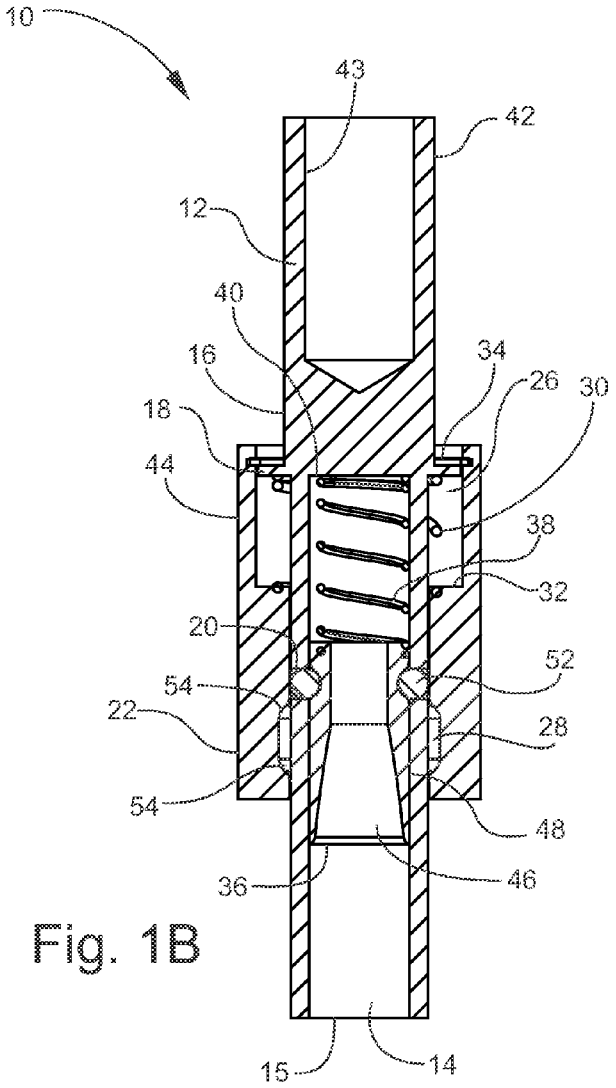
FIG. 1B is a sectional view along the line 1B-1B of FIG. 1A.
Figure 1D:
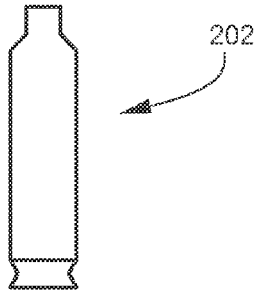
PRIOR ART Fig. 1D
FIG. 1D is a side view of a known cartridge case.

FIG. 1A is a top view of one embodiment of an automatic crimping tool 10. FIG. 1B is a sectional view along the line 1B-1B of FIG. 1A. Automatic crimping tool 10 may be used to seat and crimp a projectile 200 (FIG. 1C) in a cartridge case 202 (FIG. 1D). Projectile 200 may have a caliber in a range of, for example, about 25 mm to about 60 mm.

Figure 2B:
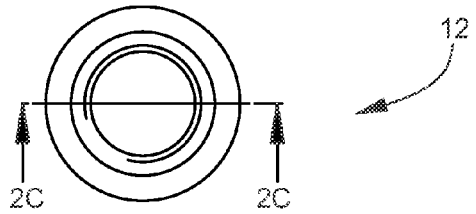
FIG. 2B is a top view of FIG. 2A.
Figure 2C:
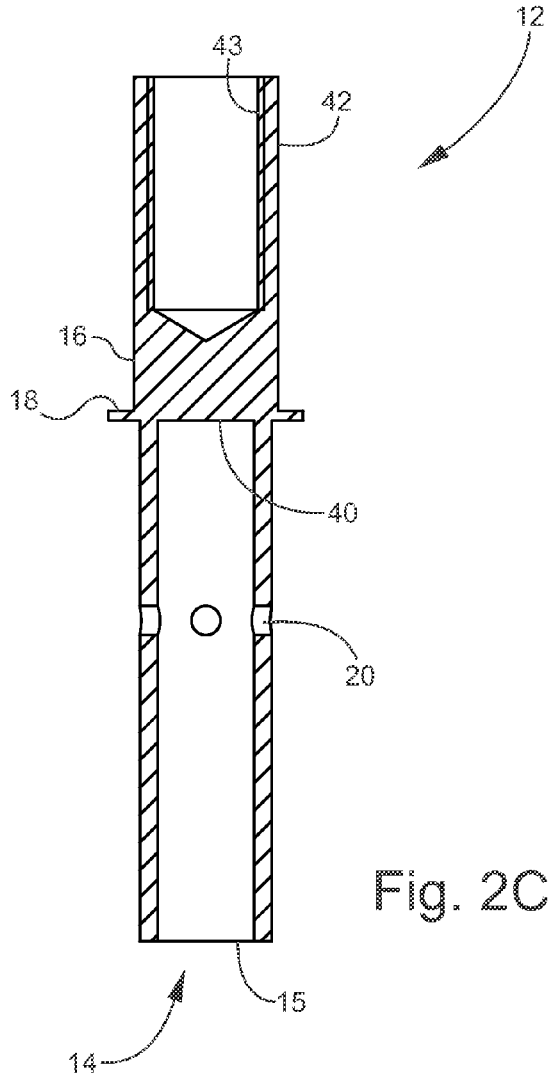
FIG. 2C is a sectional view along the line 2C-2C of FIG. 2B.
Figure 2A:
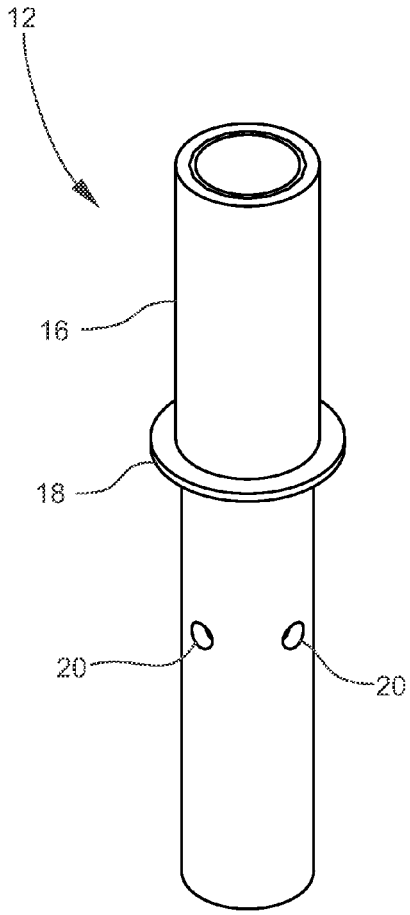
FIG. 2A is a perspective view of an embodiment of a center sleeve for the automatic crimping tool of FIGS. 1A-B.

Tool 10 may include a center sleeve 12 having a blind bore 14 at one end, an outer surface 16, a spring stop 18 disposed on outer surface 16, and one or more openings 20 that extend through the wall of blind bore 14. Openings 20 may be located axially between spring stop 18 and an open end 15 of blind bore 14. Center sleeve 12 may include a ram mating portion 42 at another end for fixing center sleeve 12 to, for example, a ram of a hydraulic press (not shown). Ram mating portion 42 may include, for example, an internally threaded bore 43. One embodiment of center sleeve 12 is shown in more detail in FIGS. 2A-C.

Figure 3A:
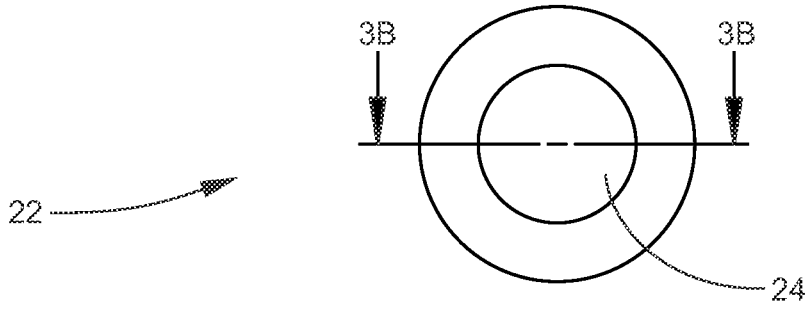
FIG. 3A is a bottom view of an embodiment of an outer sleeve for the automatic crimping tool of FIGS. 1A-B.
Figure 3B:
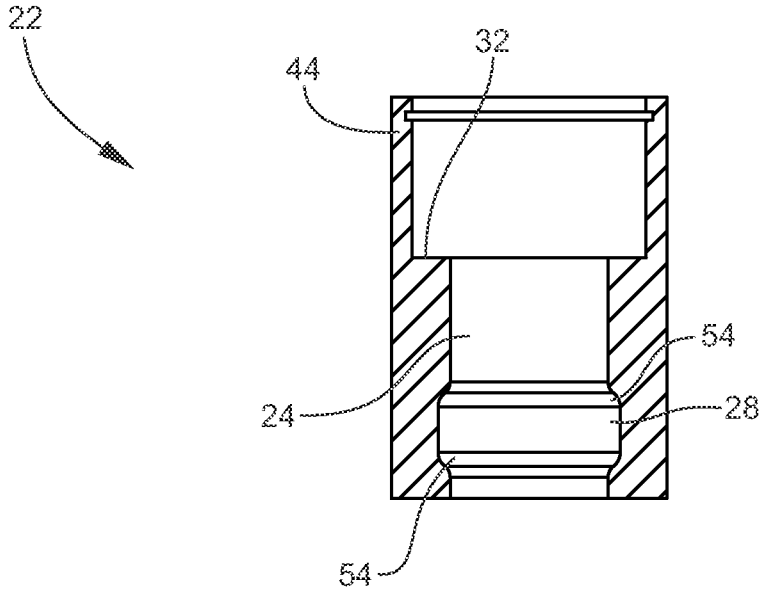
FIG. 3B is a sectional view along the line 3B-3B of FIG. 3A.

Tool 10 may include an outer sleeve 22 having a through bore 24 (FIGS. 3A-B). Center sleeve 12 may be reciprocably disposed in through bore 24 of outer sleeve 22. Through bore 24 may include a counter bore 26 at one end and an enlarged portion 28 located distal from counter bore 26. A spring 30 may be disposed between a flat portion 32 of counter bore 26 and spring stop 18. A retainer, for example, a retaining ring 34, may bear against spring stop 18 to limit axial motion of center sleeve 12. Retaining ring 34 may be disposed in a wall 44 of counter bore 26.

An inner sleeve 36 may be disposed in blind bore 14. Inner sleeve 36 may be selectively translatable with center sleeve 12. A second spring 38 may be disposed between a closed end 40 of blind bore 14 and inner sleeve 36. Inner sleeve 36 may include an opening 46 therein for receiving projectile 200. An outer surface 48 of inner sleeve 36 may include a decreased diameter portion 50. Decreased diameter portion 50 may extend completely around inner sleeve 36. Tool 10 may include one or more bearings 52 disposed in respective openings 20 that extend through wall of blind bore 14. Bearings 52 may be, for example, ball bearings.

When bearings 52 are partially disposed in decreased diameter portion 50 of outer surface 48 of inner sleeve 36, as shown in FIG. 1B, inner sleeve 36 may translate with outer sleeve 22. When bearings 52 are partially disposed in enlarged portion 28 of through bore 24 of outer sleeve 22, inner sleeve 36 may not translate with outer sleeve 22. Transitions areas 54 from enlarged portion 28 of through bore 24 to the unenlarged portion of through bore 24 may be, for example, smooth transitions rather than step transitions.

Figure 5A:
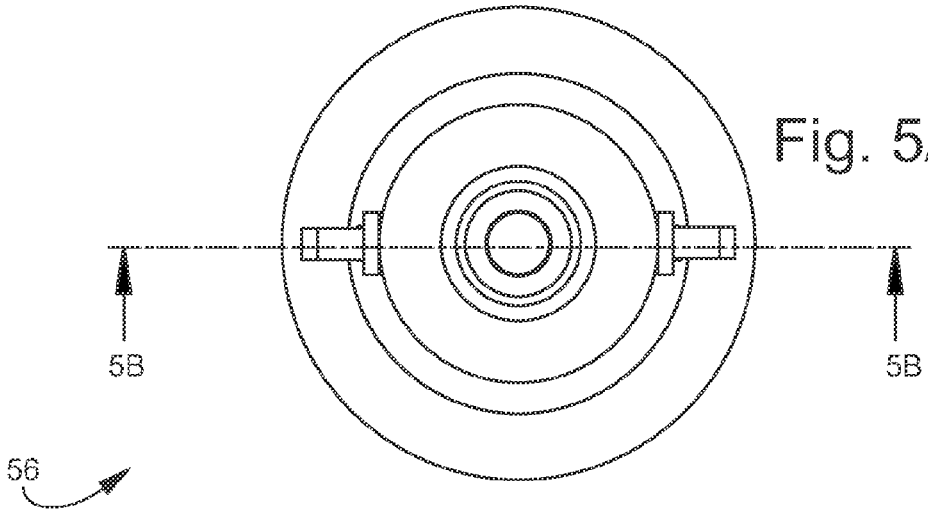
FIG. 5A is a top view of an embodiment of a crimper base assembly.
Figure 5B:
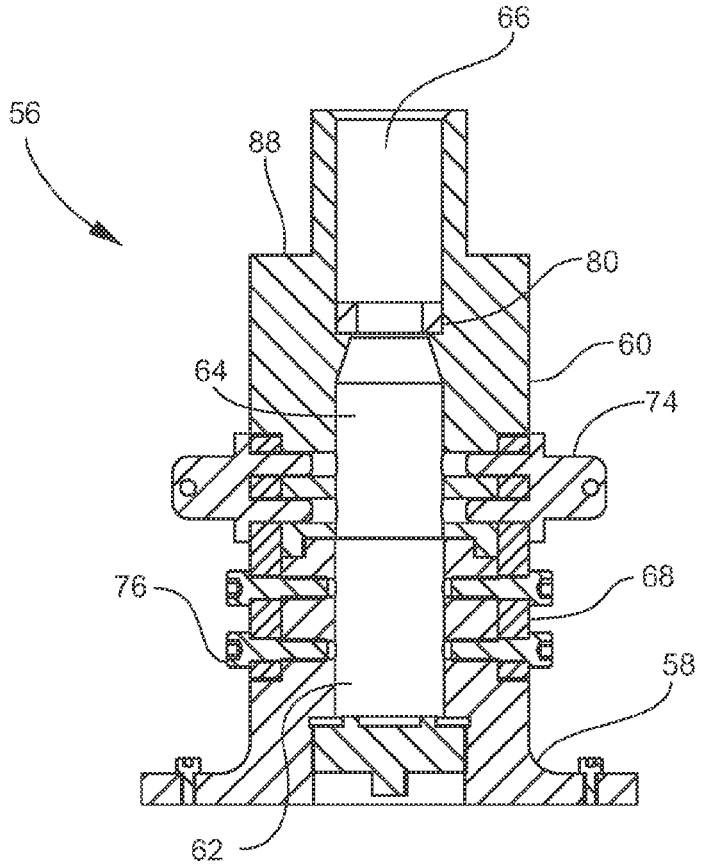
FIG. 5B is a sectional view along the line 5B-5B of FIG. 5A.
Figure 6A:
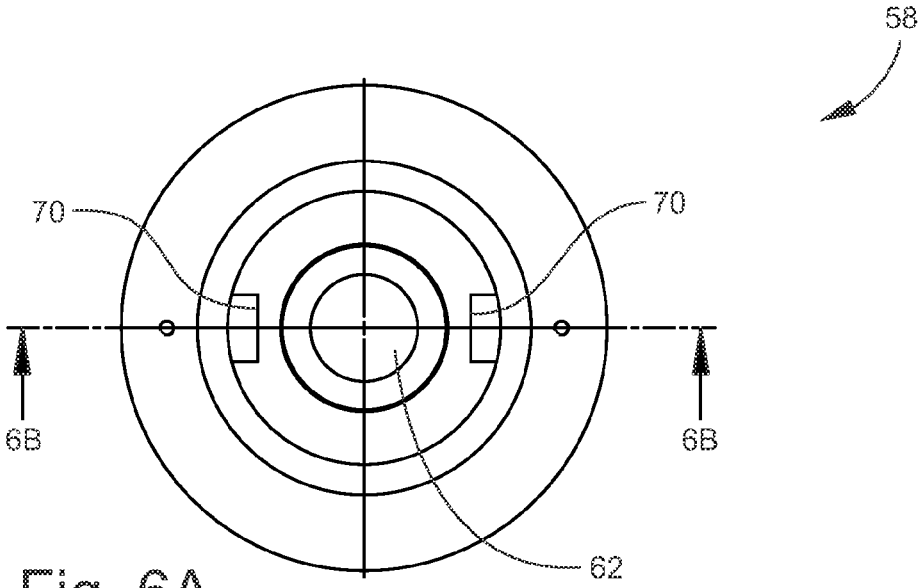
FIG. 6A is a top view of the crimper base shown in FIGS. 5A-B.
Figure 6B:
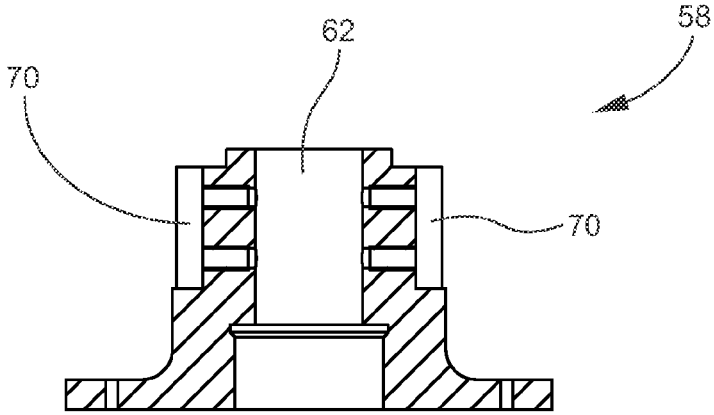
FIG. 6B is a sectional view along the line 6B-6B of FIG. 6A.
Figure 8A:
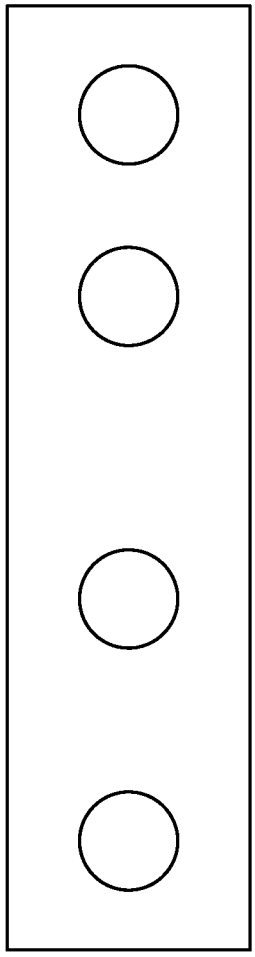
FIGS. 8A and 8B are front and side views, respectively, of the locking block shown in FIGS. 5A-B.
Figure 8B:
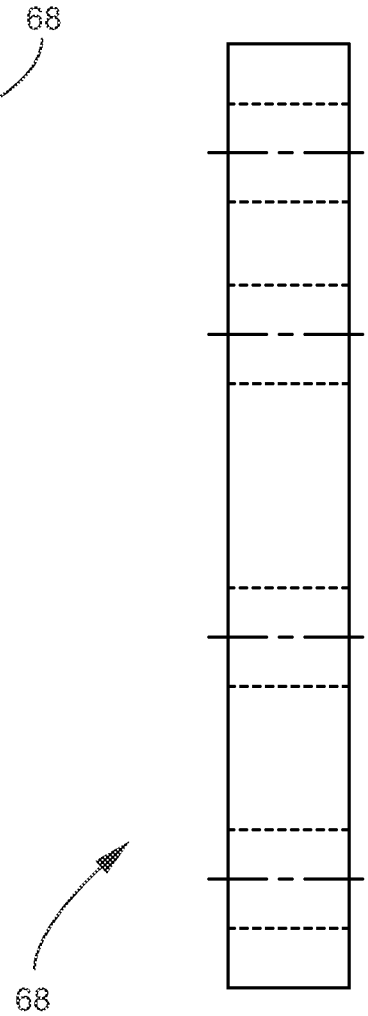

Tool 10 may include a crimper base assembly 56 (FIGS. 5A-B). Crimper base assembly 56 may include a crimper base 58 (FIGS. 6A-B) and a crimper top 60 (FIGS. 7A-B) disposed on crimper base 58. Crimper base 58 and crimper top 60 may include respective bores 62, 64 for holding cartridge case 202. Crimper top 60 may include a center sleeve bore 66 for receiving center sleeve 12. Crimper base assembly 56 may include at least one locking block 68 (FIGS. 8A-B). Two locking blocks 68 are shown in FIGS. 5A-B. Locking blocks 68 may extend from crimper base 58 to crimper top 60. Crimper base 58 and crimper top 60 may include respective slots 70, 72 formed therein for receiving locking blocks 68.

Locking blocks 68 may be fixed to crimper base 58. For example, locking blocks 68 may be fixed to crimper base 58 with fasteners 76 inserted through locking block 68 and into crimper base 58. Crimper base assembly 56 may include at least one locking pin 74 (FIGS. 9A-D) for securing locking blocks 68 to crimper top 60. Two locking pins 74 are shown in FIGS. 5A-B. Locking pins 74 may include projections 78 that extend through locking blocks 68 and into crimper top 60. Projections 78 may have a snug fit in locking blocks 68 and crimper top 60. The snug fit may allow projections 78 of locking pins 74 to be easily inserted into and removed from locking blocks 68 and crimper top 60. When projections 78 are inserted into locking blocks 68 and crimper top 60, crimper top 60 may not separate from crimper base 58 during projectile seating and cartridge case crimping operations.

In operation, crimper base 58 of tool 10 may be fixed in a location beneath a press (not shown). Cartridge case 202 may be inserted in bore 62 in crimper base 58. Crimper top 60 may then be placed on crimper base 58 and secured with locking pins 74. A rubber die 80 (FIG. 5B) may be inserted in a bottom of bore 66 and projectile 200 place on top of rubber die 80. Ram mating portion 42 of center sleeve 12 may be fixed to the press. Center sleeve 12 may be lowered with outer sleeve 22 such that open end 15 of blind bore 14 enters bore 66 in crimper top 60. As center sleeve 12 is lowered, inner sleeve 36 may also be lowered due to the position of bearings 52, as shown in FIG. 1B.

Figure 4B:
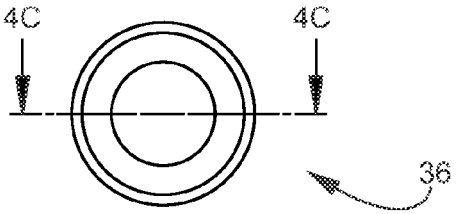
FIG. 4B is a bottom view of FIG. 4A.
Figure 4A:
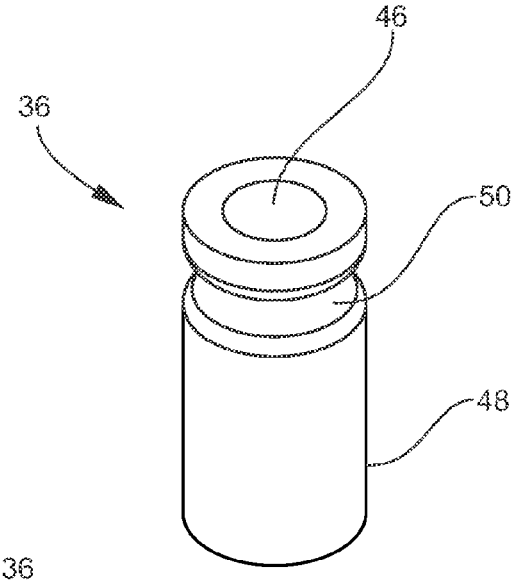
FIG. 4A is a perspective view of an embodiment of an inner sleeve for the automatic crimping tool of FIGS. 1A-B.
Figure 4C:
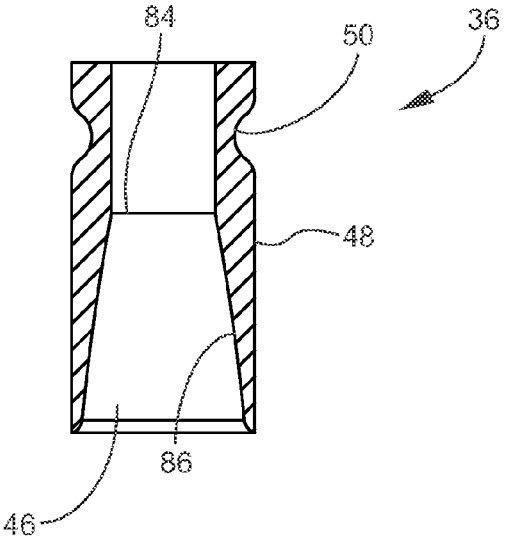
FIG. 4C is a sectional view along the line 4C-4C of FIG. 4B.

When the tip of projectile 200 reaches an end 84 of tapered portion 86 of opening 46 (FIGS. 1B and 4C), projectile 200 may be pushed into a top of cartridge case 202. A bottom surface 82 of outer sleeve 22 may then contact an upper surface 88 of crimper top 60 (FIG. 5B). Then, center sleeve 12 and inner sleeve 36 may move further downward to fully seat projectile 200 as bearings 52 are pushed into transition areas 54 and enlarged portion 28 of through bore 24. Spring force from spring 38 on inner sleeve 36 may facilitate the movement of bearings 52 into enlarged portion 28. With bearings 52 disengaged from inner sleeve 36, center sleeve 12 may continue downward such that open end 15 compresses rubber die 80 thereby crimping cartridge case 202 around projectile 200.

Then, the press may reverse the direction of movement of the ram and pull the center sleeve 12 upward. As the center sleeve 12 moves upward, bearings 52 may move from a position in enlarged portion 28 and openings 20 to another position in openings 20 and decreased diameter portion 50 of inner sleeve 36. This change in position of bearings 52 may translatably lock inner sleeve 36 to center sleeve 12. As center sleeve 12 continues to move upward, spring stop 18 may contact retaining ring 34, thereby translatably locking outer sleeve 22 to center sleeve 12. When center sleeve 12 is clear of crimper base assembly 56, cartridge case 202 with projectile 200 seated and crimped therein may be removed from crimper base assembly 56.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An automatic crimping tool for seating and crimping a projectile in a cartridge case, the automatic crimping tool, comprising:

a center sleeve including a blind bore at one end and a ram mating portion at another end, an outer surface, a spring stop disposed on the outer surface, and at least one opening extending through a wall of the blind bore, the at least one opening being located axially between the spring stop and an open end of the blind bore;

an outer sleeve having a through bore, the center sleeve being reciprocably disposed in the through bore of the outer sleeve, the through bore including a counter bore at one end and an enlarged portion located distal from the counter bore;

a spring disposed between a flat portion of the counter bore and the spring stop;

a retainer that bears against the spring stop to limit axial motion of the center sleeve;

an inner sleeve disposed in the blind bore, the inner sleeve being selectively translatable with the center sleeve and wherein the inner sleeve includes an opening therein for receiving a projectile; and a second spring disposed between a closed end of the blind bore and the inner sleeve.

2. The tool of claim 1, wherein the retainer comprises a retaining ring disposed in a wall of the counter bore.

3. The tool of claim 1, wherein an outer surface of the inner sleeve includes a decreased diameter portion, the tool further comprising at least one bearing disposed in the at least one opening extending through the wall of the blind bore.

4. The tool of claim 3, wherein, when the at least one bearing is partially disposed in the decreased diameter portion of the outer surface of the inner sleeve, the inner sleeve translates with the outer sleeve.

5. The tool of claim 4, wherein, when the at least one bearing is partially disposed in the enlarged portion of the through bore of the outer sleeve, the inner sleeve does not translate with the outer sleeve.

6. The tool of claim 5, wherein transition areas from the enlarged portion of the through bore to the through bore are smooth transitions and not step transitions.

7. The tool of claim 1, wherein the ram mating portion includes an internally threaded bore.

8. The tool of claim 1, further comprising a crimper base assembly, the crimper base assembly including a crimper base and a crimper top disposed on the crimper base, the crimper base and crimper top including bores for containing the cartridge case, the crimper top including a center sleeve bore for receiving the center sleeve.

9. The tool of claim 8, wherein the crimper base assembly includes at least one locking block extending from the crimper base to the crimper top, the locking block being fixed to the crimper base.

10. The tool of claim 9, wherein the crimper base and the crimper top include slots formed therein for receiving the at least one locking block.

11. The tool of claim 10, wherein the crimper base assembly includes at least one locking pin for securing the locking block to the crimper top.

12. The tool of claim 9, wherein the locking block is fixed to the crimper base with fasteners inserted through the locking block and into the crimper base.

13. The tool of claim 11, wherein the locking pin includes projections that extend through the locking block and into the crimper top.

* * * * *